US005301372A

United States Patent [19]

Matoba

[11] Patent Number: 5,301,372

[45] Date of Patent: Apr. 12, 1994

[54] FASTENER FOR RELEASABLY FASTENING FACE GUARD TO HELMET

[75] Inventor: Hiroshi Matoba, Toyama, Japan

[73] Assignee: Yoshida Kogyo K. K., Tokyo, Japan

[21] Appl. No.: 18,515

[22] Filed: Feb. 17, 1993

[30] Foreign Application Priority Data

Feb. 27, 1992 [JP] Japan ..... 4-9320[U]

[51] Int. Cl.[5] ..... A42B 1/08

[52] U.S. Cl. ..... 2/424; 24/597; 24/702

[58] Field of Search ..... 2/9, 10, 422, 424, 425, 2/251; 24/597, 702, 650

[56] References Cited

U.S. PATENT DOCUMENTS

| | | | |
|---|---|---|---|
| 4,070,712 | 1/1978 | Marwitz | 2/10 |
| 4,188,145 | 2/1980 | Poling | 24/702 |
| 4,581,775 | 4/1986 | Nava | 2/424 |
| 4,744,107 | 5/1988 | Fohl | 2/422 |
| 5,054,170 | 10/1991 | Otrusina | 24/597 |
| 5,084,918 | 2/1992 | Breining et al. | 2/424 |
| 5,088,131 | 2/1992 | Kamata | 2/424 |

FOREIGN PATENT DOCUMENTS

| | | |
|---|---|---|
| 0348841 | 1/1990 | European Pat. Off. . |
| 0368360 | 5/1990 | European Pat. Off. . |
| 33397 | 3/1885 | Fed. Rep. of Germany . |
| 89002 | 8/1895 | Fed. Rep. of Germany . |
| 213415 | 11/1907 | Fed. Rep. of Germany . |
| 2-133603 | 5/1990 | Japan . |
| 2-82729 | 6/1990 | Japan . |
| 103033 | 1/1924 | Switzerland . |
| 1329759 | 8/1987 | U.S.S.R. . |

OTHER PUBLICATIONS

Soviet Inventions Illustrated, Section PQ, Week 8811, Derwent Publications Ltd., London, GB; Class P21, AN 88-076441.

*Primary Examiner*—Clifford D. Crowder
*Assistant Examiner*—Michael A. Neas
*Attorney, Agent, or Firm*—Hill, Steadman & Simpson

[57] ABSTRACT

A fastener for releasably fastening a face guard to a helmet is disclosed. The fastener comprises a plug having a plug proper and an attachment portion integrally joined to each other; and a bowl-shaped socket having an engaging hole and a notch formed in the center and the edge, respectively, of its bottom, the notch communicating with the engaging hole for guiding the plug proper into engagement with the engaging hole of the socket. The fastener further includes a retainer rotatably fitted in the bowl-shaped socket and including a cylindrical body and a closing plate mounted on its bottom for selectively opening and closing the notch in response to rotation of the retainer.

11 Claims, 5 Drawing Sheets

FASTENER FOR RELEASABLY FASTENING FACE GUARD TO HELMET

BACKGROUND OF THE INVENTION

1. Field of the Invention

The present invention relates to a fastener for releasably fastening a face guard or visor to a helmet for motorcycle riders etc. and particularly to such a fastener which facilitates fastening and unfastening the face guard to the helmet and which is completely immune from accidental unfastening.

2. Description of the Prior Art

One typical fastener of the type described is disclosed in Japanese Patent Laid-open Publication No. 2-133603. The disclosed fastener comprises a plug holder having a plug mounted thereon so as to be capable of coming into and out of the plug holder; a bowl-shaped socket having a central hole and a resilient hollow cylindrical portion provided on one side of the socket and surrounding the central hole, the forward end of the plug being resiliently engageable with the resilient cylindrical portion of the socket; and a pusher including a circular base plate and a push rod protuberantly mounted on the middle thereof, the pusher reciprocally mounted on the other side of the socket with the push rod fit through the central hole. In order to couple the plug with the socket, a wearer presses the plug holder against the socket with the protruding plug registering with the hollow cylindrical portion until the plug comes into engagement with the resilient cylindrical portion of the socket. In order to decouple the plug holder from the socket, he must press the pusher against the socket until the pusher rod intrudes into the hollow cylindrical portion of the socket and pushes the plug out of engagement with the resilient cylindrical portion.

Another fastener of the type described is disclosed in Japanese Utility Model Laid-open Publication No. 2-82729. The fastener comprises a plug holder having a base, a plug protuberantly provided on the upper surface of the base, a lever pivotally mounted at its middle on the base and a plate spring acting between one end of the lever and the base and normally urging said one end upward and the other end of the lever down against the base; and a socket having a dent and a resilient engaging rim surrounding the dent, the engaging rim being engageable with the plug of the plug holder. In order to couple the plug holder with the socket, a wearer presses the plug holder against the socket until the plug comes into engagement with the resilient rim of the socket. In order to decouple the plug holder from the socket, he depresses said one end of the lever against the bias of the plate spring whereby the other end of the lever is lifted, thus bringing the plug out of engagement with the engaging rim of the socket.

The first type of conventional fastener suffers from the following drawbacks. In order to couple the plug with the socket, the wearer must forcibly press the plug holder against the socket with the protuberant plug intruding into the hollow cylindrical portion. Since tremendous force is required to forcibly press the plug holder against the socket, the coupling operation is not so easy. Furthermore, all that is necessary for decoupling the plug from the socket is to press the pusher exposed on the outer surface of the socket. So, the pusher can be pushed by the wearer unconsciously or by something extraneous accidentally, so that the plug holder is very likely to come out of engagement with the socket accidentally.

This is also the case with the second type of conventional fastener; that is; since tremendous force is necessary to press the plug holder against the socket the coupling operation is not so easy. Furthermore, all that he must do to decouple the plug holder from the socket is to press one end of the lever which is exposed on the outer surface of the plug holder. So, the lever can be depressed by the wearer unconsciously or mistakenly or by something extraneous accidentally, so that the plug holder comes out of engagement with the socket accidentally.

SUMMARY OF THE INVENTION

With the foregoing difficulties in view, it is therefore an object of the present invention to provide a fastener for fastening a face guard to a helmet wherein a plug can be coupled and decoupled with a socket very easily if done on purpose and, once the plug is coupled with the socket, the plug can be retained in coupled position reliably and will never be decoupled from the socket unless done on purpose.

According to the present invention, there is provided a fastener for releasably fastening a face guard to a helmet, the fastener comprising a plug having a plug proper and an attachment portion integrally joined to each other; a bowl-shaped socket having an engaging hole and a notch formed in the center and the edge, respectively, of its bottom, the notch communicating with the engaging hole for guiding the plug proper into engagement with the engaging hole of the socket, the socket further having on its upper rim a peripheral flange which has a pair of diametrically-opposed locking prongs; and a retainer rotatably fitted in the bowl-shaped socket and including a cylindrical body and a closing plate mounted on its bottom for selectively opening and closing the notch in response to rotation of the retainer, the retainer having a locking recess formed in its upper peripheral edge and selectively engageable with the locking prongs of the socket for retaining the retainer in a notch-opening position and a notch-closing position.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 6:
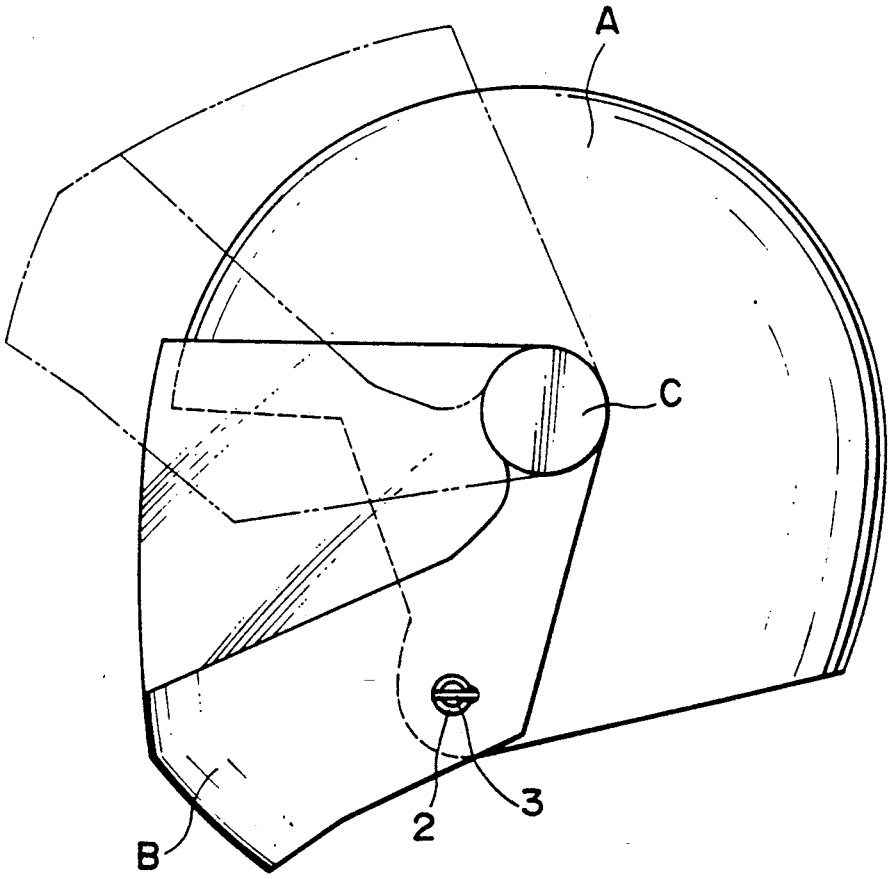
FIG. 6 is a side view of a helmet showing how the fastener is used to fasten the face guard to the helmet.
Figure 7:
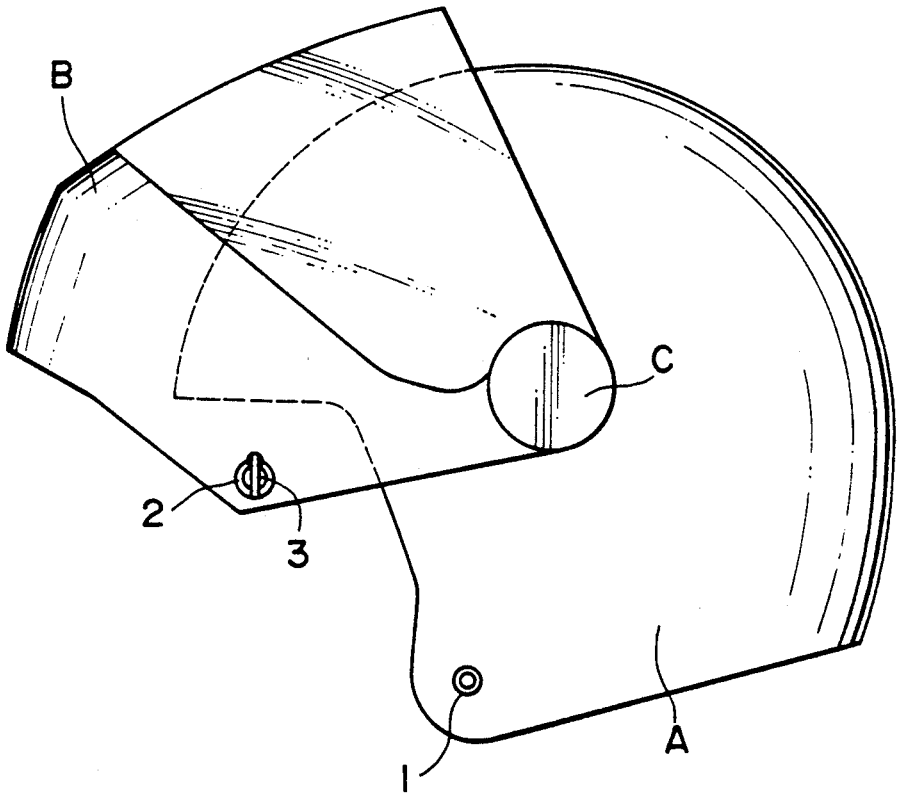
FIG. 7 is a view similar to FIG. 6 but showing the face guard lifted.

As shown in FIGS. 6 and 7, a fastener according to the present invention is used for releasably fastening to a helmet A a face guard B or visor which is pivotally mounted on the helmet A around a pivot C.

As shown in FIGS. 1 through 5, the fastener broadly comprises three parts; that is, a plug 1, a socket 2 and a retainer 3.

Figure 4:
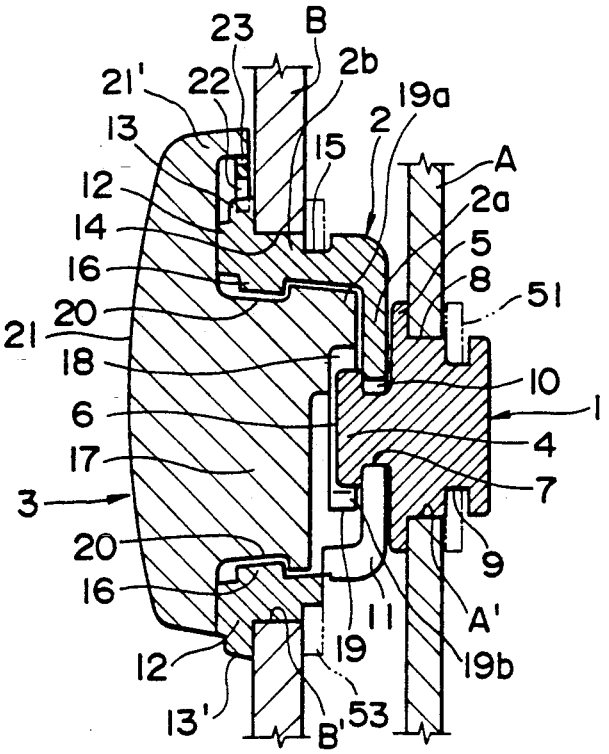
FIG. 4 is central cross-sectional view of FIG. 1 showing the retainer disposed in plug-releasing position.

As better shown in FIG. 4, the plug 1 in turn broadly comprises an engaging plug proper 4 and an attachment portion 8. The engaging plug proper 4 has a flat disk 5, a circular neck portion 7 and an enlarged circular head 6 integrally formed one over another in the order named above and disposed concentric to one another.

The attachment portion 8 is integrally connected with the lower side of the flat disc 5 and has a peripheral groove 9 formed adjacent the distal end thereof. The attachment portion 8 is fitted into an attachment aperture A' formed in either or both of the lateral sides of the helmet A and is retained thereto by fitting a washer 51 over the peripheral groove 9, so that the plug 1 is fastened to the lateral sides of the helmet A.

As also better shown in FIG. 4, the socket 2 is substantially of bowl-shape and generally includes a substantially circular bottom 2*a* and a peripheral wall 2*b* mounted around the rim of the circular bottom 2*a*. As better shown in FIG.3, the socket 2 has a central engaging hole 10 and a sectorial notch 11 formed in the center and the edge, respectively, of its circular bottom 2*a*, the sectorial notch 11 and the center communicating with each other. The sectorial notch 11 communicating with the engaging hole 10 functions as a guideway to guide the plug proper 4 of the plug 1 into engagement with the engaging hole 10 of the socket 2, so that it is easier to couple the plug 1 and the socket 2. The neck portion 7 of the plug 1 is loosely fitted in the engaging hole 10 of the socket 2.

Figure 2:
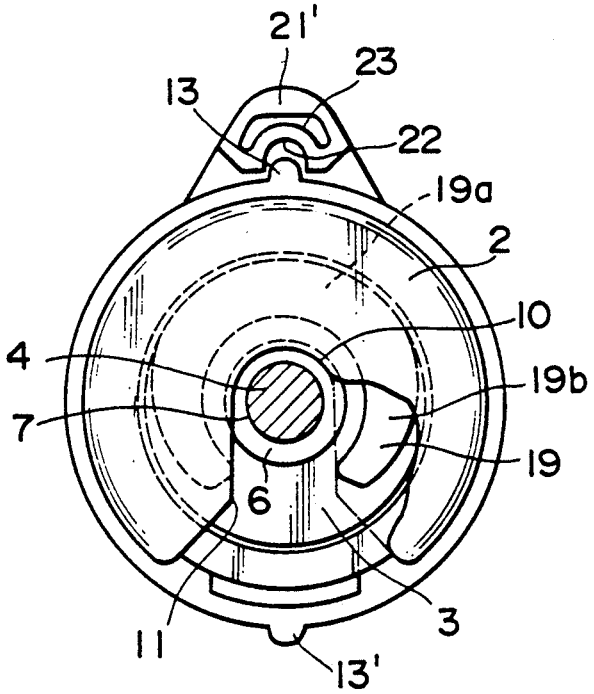
FIG. 2 is a rear view of the fastener of FIG. 1.

An outward-directed peripheral flange 12 is mounted on the upper outer rim of the peripheral wall 2*b* and has a pair of diametrically-opposed convexed locking lugs 13, 13' projected outward from the flange 12. A peripheral groove 15 is formed in the outer side of the peripheral wall 2*b* at the middle, to thus define with the flange 12 an attachment portion 14. The socket 2 has its attachment portion 14 fitted into an attachment aperture B' of the face guard B and is retained to the face guard B by fitting a washer 53 over the peripheral groove 15 of the socket 2. A peripheral ridge 16 is provided on the inner side of the peripheral wall 2*b* adjacent the upper rim. It is to be noted that, as shown in FIG. 2, either one of the locking lugs 13, 13' (13' in this embodiment) is disposed within the sectorial notch 11, as seen from below.

Figure 1:
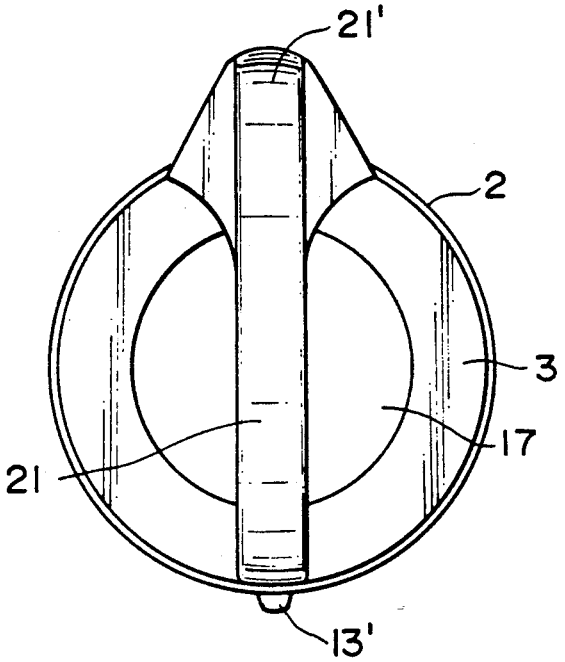
FIG. 1 is a front view of a fastener for releasably fastening a face guard to a helmet according to the present invention with a retainer disposed in so-called plug-releasing position.

As better shown in FIGS. 1 and 4, the retainer 3 comprises a cylindrical body 17 rotatably fitted into the bowl-shaped socket 2. The cylindrical body 17 has a U-shaped resilient closing plate 19 mounted on its bottom. To be specific, the U-shaped resilient closing plate 19 has its middle base 19*a* secured to the bottom of the cylindrically body 17 and has a pair of opposed arcuate arms 19*b* cantilevered from the middle base 19*a*. The two opposed arcuate arms 19*b*, 19*b* jointly define a substantially circular indentation 18 into which the enlarged circular head 6 of the engaging plug proper 4 is loosely fitted. A peripheral groove 20 is formed around the upper part of the periphery of the cylindrical body 17. As better shown in FIG. 4, when the bowl-shaped socket 2 receives the cylindrical body 17 of the retainer 3, the inner peripheral ridge 16 of the former is fitted into the peripheral groove 20 of the latter.

Figure 3:
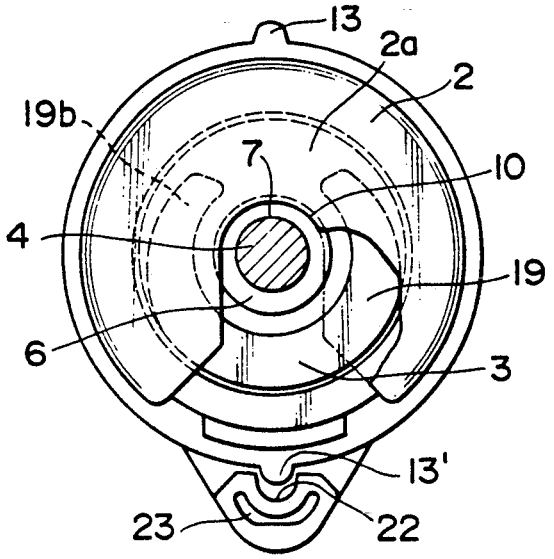
FIG. 3 is a view similar to FIG. 2 but showing the retainer disposed in so-called plug-retaining position.
Figure 5:
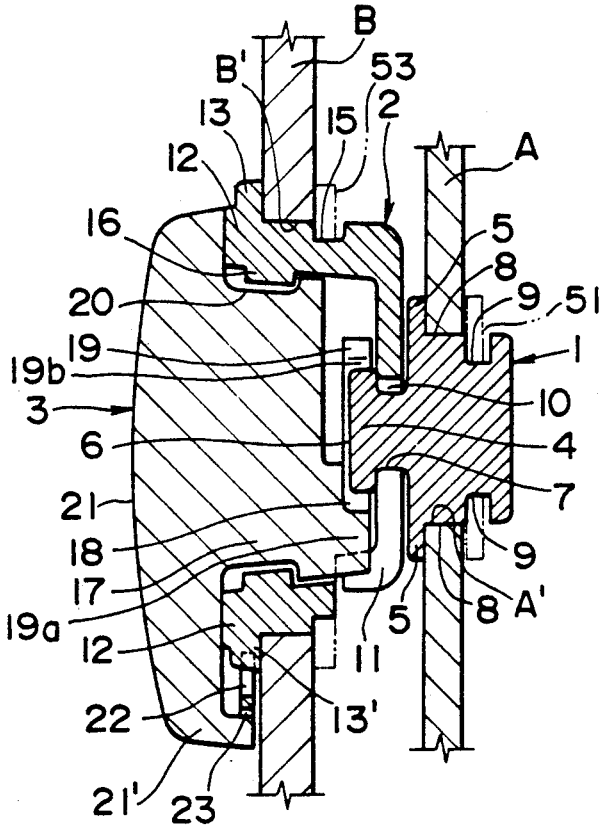
FIG. 5 is a view similar to FIG. 4 bus showing the retainer disposed in plug-retaining position.

As better shown in FIG. 1, an elongated gripping knob 21 is mounted on the upper side of the cylindrical body 17 of the retainer 3 in such a way that the gripping knob 21 extends diametrically of the cylindrical body 17 and one end of the gripping knob 21 projects outward beyond the margin of the cylindrical body 17. As better shown in FIG. 4, the projecting end of the gripping knob 21 is folded back inward to provide a U-shaped locking portion 21'. The U-shaped locking portion 21' has its end recessed to provide a concave locking recess 22 for locking engagement with the locking lugs 13, 13' provided on the peripheral flange 12 of the socket 2. The U-shaped locking portion 21' has an arcuate aperture 23 formed adjacent and along the contour of the locking recess 22 so as to impart enough resiliency to the locking recess 22. It is to be noted that the locking recess 22 is selectively engageable with the locking prongs 13, 13' of the socket 2 for retaining the retainer 3 in a notch-opening position and a notch-closing position. To be specific, as shown in FIGS. 2 and 4, when the locking recess 22 of the gripping knob 21 comes into locking engagement with the locking lug 13 of the socket 2, the U-shaped closing plate 19 of the retainer 3 opens the sectorial notch 11 for letting the plug proper 4 of the plug 1 into the engaging hole 10 through the sectorial notch 11; on the other hand as shown in FIGS. 3 and 5, when the locking recess 22 of the gripping knob 21 comes into locking engagement with the locking lug 13' of the socket 2, the U-shaped closing plate 19 of the retainer 3 closes the sectorial notch 11, thus preventing the plug proper 4 of the plug 1 from escaping from the engaging hole 10.

As explained hereinabove, the plug 1 has its attachment portion 8 fitted into the attachment hole A' of the helmet A with its engaging plug proper 4 projecting therefrom and then fastened to the helmet A by fitting the washer 51 over the peripheral groove 9. On the other hand, the socket 2 has its cylindrical attachment portion 14 fitted into the attachment hole B' of the face guard B and fastened to the face guard B by fitting the washer 53 over the peripheral groove 15. The position of the attachment hole B' in the face guard B is such that, when the face guard B is rotated counterclockwise (as viewed in FIG. 6) around the pivot C on the helmet A, the sectorial notch 11 and the engaging hole 10 of the socket 2 come into registry with the engaging plug proper 4 of the plug 1.

As better shown in FIG. 4, the cylindrical body 17 of the retainer 3 is rotatably fitted into the bowl-shaped socket 2 with the peripheral groove 20 of the former receiving the inner peripheral ridge 16 of the latter. It is acknowledged that the locking recess 22 provided in the U-shaped locking portion 21' of the gripping knob 21 is engageable with either of the diametrically opposed locking lugs 13, 13' provided on the flanges 12 of the socket 2.

Referring now to the operation of the fastener according to the present invention. Suppose that the face guard B assumes the uppermost position as indicated in phantom lines in FIG. 6 and the retainer 3 of the fastener assumes the position shown in FIGS. 2 and 4, in which position the locking recess 22 of the gripping knob 21 is in locking engagement with the locking lug 13 of the socket 2 and the U-shaped closing plate 19 of the retainer 3 opens the sectorial notch 11 of the socket 2.

First, the face guard B is rotated counterclockwise (as viewed in FIG. 6) around the pivot C on the helmet A from the uppermost position indicated in phantom lines to the lowermost position indicated by solid lines in FIG. 6, thus bringing the plug proper 4 of the plug 1 into fitting engagement with the engaging hole 10 through the opened sectorial notch 11 of the socket 2.

Then, the gripping knob 21 of the retainer 3 is gripped and rotated through the angle of 180 degrees from the position indicated in FIGS. 2 and 4. The rotation causes the retainer 3 assume the position shown in FIGS. 3 and 5 in which position the locking recess 22 of the gripping knob 21 comes into locking engagement with the locking lug 13 of the socket 2 and the U-shaped closing plate 19 closes the sectorial notch 11 of the socket 2 so that the plug proper 4 of the plug 1 is retained in the engaging hole 10. This assures that the plug 1 remains coupled with the socket 2 reliably unless the gripping knob 21 is gripped and rotated on the purpose.

In order to decouple the plug 1 from the socket 2, the gripping knob 21 is rotated through the angle of another 180 degree from the position shown in FIGS. 3 and 5. Upon rotation of the gripping knob 21, the locking recess 22 of the gripping knob 21 comes out of locking engagement with the locking lug 13 and into locking engagement with the other locking lug 13', and at the same time, the U-shaped closing plate 19 of the retainer 3 opens the sectorial notch 11, so that the engaging plug proper 4 of the plug 1 is allowed to come out of engagement with the engaging hole 10 through the sectorial notch 11, and consequently the plug 1 is decoupled from the socket 2.

With the construction set forth hereinabove, the fastener according to the present invention will enjoy the following effects.

Since the sectorial notch functions a guideway to guide the plug proper of the plug into engagement with the engaging hole of the socket, it is much more easy to couple the plug with the socket.

Since being firmly retained in coupling engagement with the socket by the locking engagement of the locking recess of the retainer with the locking lugs of the socket, the plug is quite immune from detachment therefrom. Once the plug is coupled with the socket, the plug will never to be decoupled from the socket, unless the gripping knob is gripped and rotated intentionally. In this sense, this fastener is very safe as such.

Since all that is required for decoupling the plug from the socket is to rotate the gripping knob through the angle of 180 degrees, the decoupling operation of the plug from the socket is so easy.

Once the plug is coupled with the socket, the plug will never be decoupled from the socket, unless it is done intentionally. There is no danger of the plug getting accidentally decoupled from the socket whatsoever. In this respect, this fastener is safe as such.

Since the locking recess is provided at one extremity of the gripping knob, little force is necessary to rotate the gripping knob, so that the coupling and decoupling operation of the plug and the socket can be carried out easily and smoothly.

Obviously, the skilled person would realize that various modifications and variations of the present invention are possible in the light of the above teaching. It is therefore to be understood that within the scope of the appended claims the invention may be practiced otherwise than as specifically described, and that the invention is not limited to the embodiments described above in detail.

What is claimed is:

1. A fastener for releasably fastening a face guard to a helmet, the fastener comprising a plug having a plug proper and an attachment portion integrally joined to each other; a bowl-shaped socket having an engaging hole and a notch formed in the center and the edge, respectively, of its bottom, the notch communicating with the engaging hole for guiding the plug proper into engagement with the engaging hole of the socket, the socket further having on its upper rim a peripheral flange which has a pair of diametrically-opposed locking prongs; and a retainer rotatably fitted in the bowl-shaped socket and including a cylindrical body and a closing plate mounted on its bottom for selectively opening and closing the notch in response to rotation of the retainer, the retainer having a locking recess formed in its upper peripheral edge and selectively engageable with the locking prongs of the socket for retaining the retainer in a notch-opening position and a notch-closing position.

2. A fastener for fastening a face guard to a helmet according to claim 1, the attachment portion of the plug being attachable to the helmet, the plug proper including an enlarged head and a neck portion formed beneath the enlarged head, the neck portion being loosely fitted in the engaging hole of the socket, the socket being attachable to the face guard.

3. A fastener for fastening a face guard to a helmet according to claim 1, either one of the locking prongs of the socket being disposed within the notch of the socket as seen from below.

4. A fastener for fastening a face guard to a helmet according to claim 1, wherein the notch is sectorial.

5. A fastener for fastening a face guard to a helmet according to claim 1, wherein the closing plate being of U-shape and engageable with the enlarged head of the plug proper; the retainer further having a gripping knob diametrically mounted on the upper surface of the cylindrical body, one end of the gripping knob extending outward beyond the periphery of the cylindrical body and being folded back inward to provide a U-shaped locking portion, the locking recess being formed in the end of the U-shaped locking portion, the locking prongs protruding outward from the peripheral flange.

6. A fastener for releasably fastening a face guard to a helmet, the fastener comprising a plug having a plug proper and an attachment portion integrally joined to each other; a socket having an engaging hole and a notch formed in the center and the edge, respectively, of its bottom, the notch communicating with the engaging hole for guiding the plug proper into engagement with the engaging hole of the socket, and a retainer rotatably fitted in the socket and including a cylindrical body and a closing plate mounted on its bottom for selectively opening and closing the notch in response to rotation of the retainer, and means for selectively retaining the retainer in a notch-opening position and a notch-closing position.

7. A fastener according to claim 6, wherein said means for selectively retaining comprises a pair of diametrically opposed locking prongs arranged on a peripheral flange of said socket; and a locking recess formed in an upper peripheral edge of the retainer and being selectively engageable with the locking prongs of the socket.

8. A fastener for fastening a face guard to a helmet according to claim 7, either one of the locking prongs of the socket being disposed within the notch of the socket as seen from below.

9. A fastener for fastening a face guard to a helmet according to claim 7, wherein the closing plate being of U-shape and engageable with an enlarged head of the plug proper; the retainer further having a gripping knob diametrically mounted on the upper surface of the cylindrical body, one end of the gripping knob extending outwardly beyond the periphery of the cylindrical body and being folded back inward to provide a U-shaped locking portion, the locking recess being formed in the end of the U-shaped locking portion, the locking prongs protruding outward from the peripheral flange.

10. A fastener for fastening a face guard to a helmet according to claim 6, the attachment portion of the plug being attached to the helmet, the plug proper including an enlarged head and a neck portion formed beneath the enlarged head, the neck portion being loosely fitted in the engaging hole of the socket, socket being attached to the face guard.

11. A fastener for fastening a face guard to a helmet according to claim 6, wherein the notch is sectorial.

* * * * *